US007034749B2

(12) United States Patent
Leeper et al.

(10) Patent No.: US 7,034,749 B2
(45) Date of Patent: Apr. 25, 2006

(54) ANTENNA SYSTEM FOR IMPROVING THE PERFORMANCE OF A SHORT RANGE WIRELESS NETWORK

(75) Inventors: David G. Leeper, Scottsdale, AZ (US); Thomas A. DeMarchi, Mission Viejo, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/214,679

(22) Filed: Aug. 7, 2002

(65) Prior Publication Data

US 2004/0027284 A1 Feb. 12, 2004

(51) Int. Cl.
*H01Q 1/38* (2006.01)

(52) U.S. Cl. ..... 343/700 MS; 343/754; 343/795; 343/878

(58) Field of Classification Search ..... 343/700 MS, 343/878, 879, 880, 881, 882, 915, 890, 754, 343/795
See application file for complete search history.

(56) References Cited

U.S. PATENT DOCUMENTS 5,552,798 A * 9/1996 Dietrich et al. ..... 343/893
5,969,689 A * 10/1999 Martek et al. ..... 343/758
6,160,514 A * 12/2000 Judd ..... 343/700 MS
6,198,460 B1 * 3/2001 Brankovic ..... 343/879
6,448,930 B1 * 9/2002 Judd ..... 343/700 MS
6,456,242 B1 * 9/2002 Crawford ..... 343/700 MS
6,782,277 B1 * 8/2004 Chen et al. ..... 342/359

FOREIGN PATENT DOCUMENTS

| | | |
|---|---|---|
| EP | 0936693 | 8/1999 |
| WO | WO-01/29926 | 4/2001 |
| WO | WO-02/31908 | 4/2002 |

OTHER PUBLICATIONS

Chen, James C., et al., "Measured Performance of 5-GHz 802.11a Wireless LAN Systems", Atheros Communications, Inc., (Aug. 27, 2001), 1-11.
Markus, J., et al., *McGraw-Hill Electronics Dictionary*, Fifth Edition, McGraw-Hill, Inc., (1994),p. 390.
Weik, M. H., *Communications Standard Dictionary*, Van Nostrand Reinhold Company,(1983),p. 678.

* cited by examiner

*Primary Examiner*—Tho Phan
(74) *Attorney, Agent, or Firm*—Schwegman, Lundberg, Woessner & Kluth, P.A.

(57) ABSTRACT

An antenna system for providing network access services to wireless users generates at least a first and a second antenna beam, where the second antenna beam is movable with respect to the first. Additional antenna beams may also be generated. During installation of the antenna system, an installer may adjust the position of the second antenna beam (and possibly other antenna beams) in a manner that enhances the maximum data-rate coverage area of the antenna system for a given deployment region.

39 Claims, 7 Drawing Sheets

ANTENNA SYSTEM FOR IMPROVING THE PERFORMANCE OF A SHORT RANGE WIRELESS NETWORK

BACKGROUND OF THE INVENTION

Short range wireless technologies (e.g., IEEE 802.11a, IEEE 802.11b, Bluetooth®, Ultrawideband, HomeRF, HIPERLAN, etc.) are becoming increasingly popular for providing communication between both fixed and portable devices. Such technologies are capable of providing low power, low-cost, high-bandwidth communication to a variety of users. In one possible application, such technologies may be used to provide wireless communication between a user device and a network access point. The network access point may serve, for example, as a gateway to the Internet or to another large network. Such network access points have traditionally used omni-directional antennas to communicate with surrounding users. Thus, the strength at which signals are received by a user device from the access point drops rapidly with increasing distance from the access point. As the receive signal strength drops off, the data rate that is sustainable over the wireless link decreases accordingly. As a result, maximum data rates are only supportable within a small area about the access point. It is generally desirable that the area of maximum data rate coverage about a wireless access point be as large as practically possible. It is also generally desirable that the area within which maximum data rates are achievable be easily conformable to a region within which the access point is being deployed.

DETAILED DESCRIPTION

Figure 1:
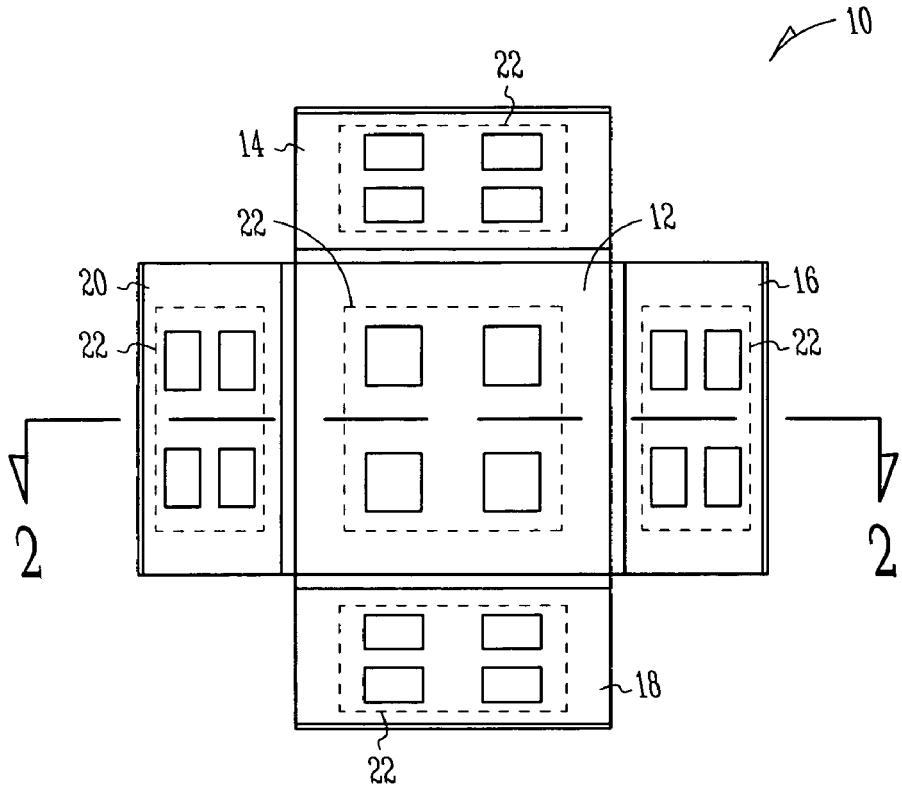
FIG. 1 is a bottom view of an antenna system in accordance with an embodiment of the present invention.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

Figure 2:
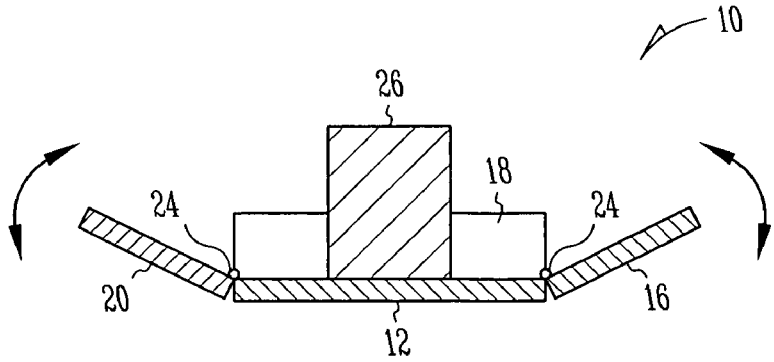
FIG. 2 is a sectional side view of the antenna system of FIG. 1.

FIG. 1 is a bottom view of an antenna system 10 in accordance with an embodiment of the present invention. In at least one application, the antenna system 10 is used to provide short range wireless access point services to users who desire connection to a network. As used herein, the term "short-range" refers to distances of 100 meters or less. As illustrated, the antenna system 10 includes a main panel 12 and four pivotable side panels 14, 16, 18, 20. The main panel 12 and each of the side panels 14, 16, 18, 20 has a corresponding array of antenna elements 22 disposed thereon. Each array of elements 22 is operative for generating a corresponding antenna beam (receive and/or transmit) during system operation. Thus, the antenna system 10 of FIG. 1 will generate 5 main beams during normal operation (side lobes may also be present). FIG. 2 is a sectional side view of the antenna system 10 of FIG. 1 illustrating the connection of the side panels 16, 20 to the main panel 12 using hinges 24. Any form of hinge may be used. As will be described in greater detail, a locking mechanism may also be provided to lock each side panel 14, 16, 18, 20 in a fixed position when the antenna system 10 is eventually installed. The antenna system 10 may also include a mount 26 for use in mounting the system 10 within a deployment region (e.g., a region within which network access services are to be provided). The mount 26 may include any structure or structures capable of facilitating attachment of the antenna system 10 in a desired position in the deployment region. The mount 26 may also provide a conduit for any electrical and/or feed lines that will need to be directed to the antenna system.

When deployed, the antenna system 10 is mounted in an elevated position within the deployment region. This may include, for example, a ceiling mount, a pole mount, a wall mount, or other similar mount locations. During antenna operation, each of the beams generated by the antenna system 10 is directed in a generally downward direction to "illuminate" a corresponding portion of the floor space below. The overall coverage pattern of the antenna system 10 is a combination of the individual footprints of each of these beams. During installation of the antenna system 10, an installer may make adjustments to the antenna system 10, based on the characteristics of the particular deployment region, so that an optimal coverage pattern is obtained for the region. That is, the antenna system 10 may be adjusted in a manner that is designed to maximize the area within which maximum data rates are supportable within the deployment region. To accomplish this, the installer may, for example, adjust and appropriately fix the angular orientation of each of the side panels 14, 16, 18, 20 with respect to the main panel 12.

The angle of the side panels 14, 16, 18, 20 may be adjusted based upon some physical characteristic of the deployment region such as, for example, the distance between the mounted antenna system 10 and the floor below (i.e., the deployment height). When the deployment height of the antenna system 10 is low (e.g., when the antenna system is ceiling mounted and the ceiling height is low), larger side panel angles may be used to broaden the area of maximum data rate coverage. In contrast, when the deployment height is larger, smaller side panel angles may be used to achieve more uniform coverage within the region. In one possible installation technique, an installer may first estimate the deployment height of the antenna system 10 and then adjust and fix the angles of the side panels 14, 16, 18, 20 accordingly. A table maybe provided that lists the appropriate side panel angles for different ranges of deployment height. The side panel angles may be adjusted either before or after the antenna system 10 is actually mounted.

Other techniques for adjusting the angles of the side panels 14, 16, 18, 20 during installation may alternatively be used. For example, in one approach, a flat reflective element (e.g., a mirror) is provided on one or more of the side panels of the antenna system 10 for use in adjusting the side panels 14, 16, 18, 20. One installer may then adjust the angle of a side panel while another installer directs, for example, a laser pointing device at the reflective element from a point where the corresponding beam is to be centered. When the laser pointer is reflected directly back upon itself, the angle of the side panel is fixed in place. A similar technique utilizes an installer's eyesight to determine whether proper alignment of the beam has been achieved. That is, one installer may stand at the point where the corresponding beam is to be centered and view the reflective element using an optical device, such as binoculars or a telescope, while another installer adjusts the angle of the corresponding side panel. When the first installer sees his own image in the reflector, he instructs the second installer to fix the side panel in place. An installer may determine the appropriate place to stand during adjustment based on criteria such as, for example, the size and shape of the room, the deployment height, knowledge of antenna beam width, etc.

In at least one implementation, one or more of the antenna arrays 22 associated with the side panels 14, 16, 18, 20 have electronic beam steering capability. That is, phased array techniques are used to provide an additional level of adjustability in the direction of the beam. Phased array techniques may also be used to provide some degree of beam shaping capability. These capabilities may be used by an installer to further improve the maximum data rate coverage pattern within the deployment region (e.g., after the mechanical adjustments have been made). For example, an installer may be able to direct a beam from one of the side panels to the left or right to obtain enhanced coverage in, for example, an odd shaped corner of a room. The installer may also decide to adjust the shape of the antenna beam (e.g., the beamwidth, etc.) to better suit a particular deployment region. To electronically adjust the direction of the main beam associated with a side panel, the excitation phases of the corresponding array elements may be adjusted. To electronically adjust the shape of the main beam, the excitation phases and amplitudes of the corresponding array elements may be adjusted. An adjustable beamformer network is typically used to provide such functionality. Such beamforming techniques are well known in the art. Once an installer has achieved an optimal beam direction and/or shape for the beam associated with a side panel, the corresponding phase and/or amplitude values are fixed within the associated beamformer and do not change thereafter (unless the antenna system 10 is subsequently moved or a periodic recalibration is performed).

Figure 3:
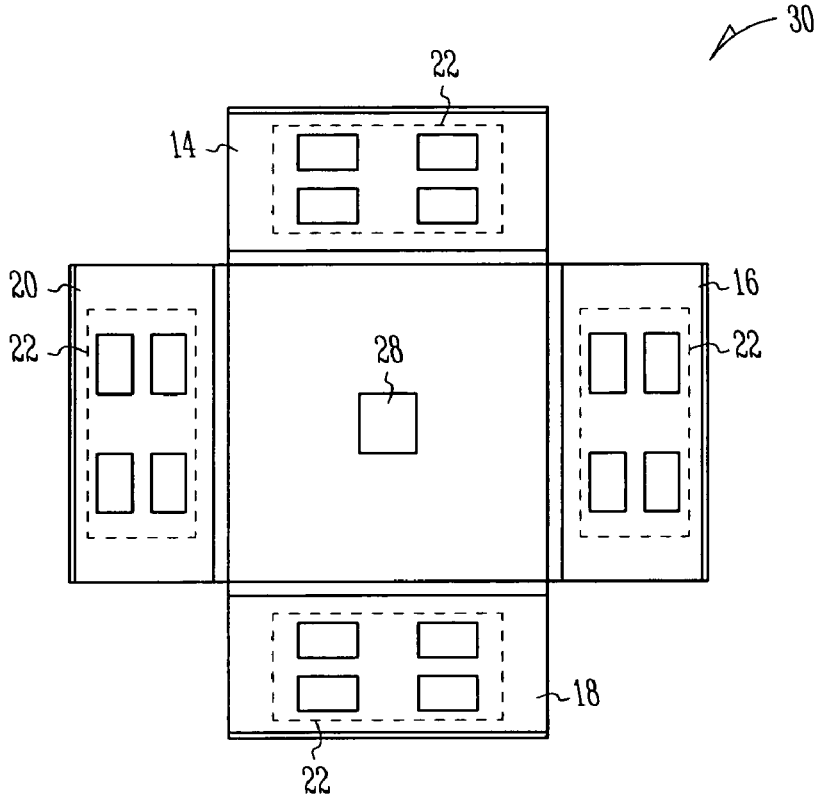
FIG. 3 is a bottom view of an antenna system in accordance with another embodiment of the present invention.

It should be appreciated that the antenna system 10 of FIG. 1 is merely illustrative of certain inventive principles and many modifications can be made thereto. For example, any number of pivotable side panels may be used. In one possible implementation, for example, only a single pivotable side panel is provided. In addition, the side panels and the main panel may assume any shape. For example, in another possible implementation, the main panel 12 has a hexagonal shape and six side panels are provided, one hinged on each edge of the hexagon. As will be appreciated, any number of different configurations can be used. Likewise, the number and configuration of the antenna elements within each array may be varied. In at least one embodiment, as illustrated in FIG. 3, an antenna system 30 is provided that includes a main panel 12 having a single antenna element 28 and side panels 14, 16, 18, 20 that each include an array of elements. It may also be desirable to include only a single element within one or more of the side panels. Any of a wide variety of different antenna element types may be used within an antenna system in accordance with the invention. In one approach, for example, microstrip patch elements are used on each of the panels. Other types of elements that can be used include, for example, dipoles, ground planes, slots, loops, and others, including combinations of the above. Any type of polarization can be used including, for example, linear, circular, elliptical, or cross-polarization.

Figure 4:
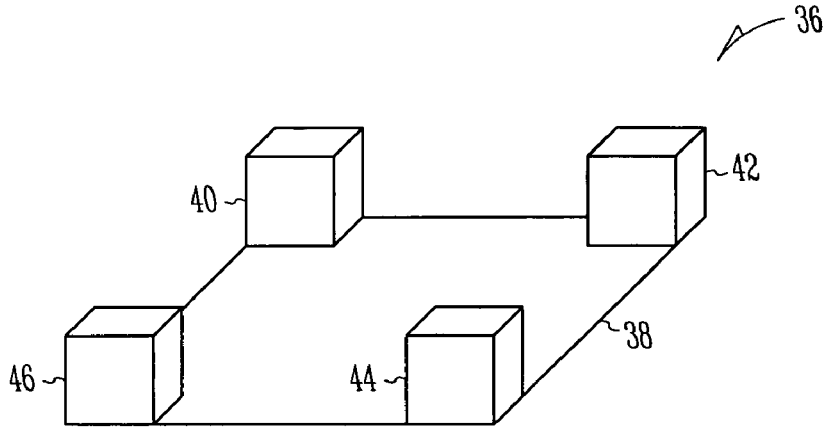
FIG. 4 is a perspective view of a fixture that is used in at least one embodiment of the invention to fix the angle of the side panels of an antenna system.
Figure 5:
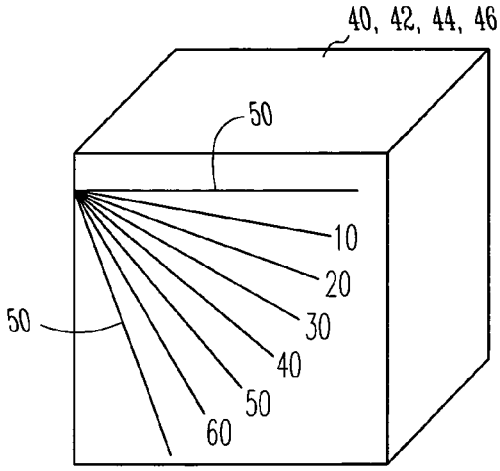
FIG. 5 is a perspective view of a corner block used within the fixture of FIG. 4 in accordance with an embodiment of the present invention.

As described previously, the antenna system 10 of FIG. 1 will typically include one or more locking mechanisms for locking the side panels 14, 16, 18, 20 in place during installation. As will be appreciated, any structure that is capable of locking a pivotable side panel in place may be used. In one approach, for example, the hinges 24 coupling the side panels to the main panel include screws (e.g., with a wingnut) that may be tightened to lock a corresponding panel in place. Clamps, brackets, and other mechanical structures may alternatively be used. FIG. 4 is a perspective view illustrating a fixture 36 that is used in at least one embodiment of the invention to fix the angle of the side panels 14, 16, 18, 20. The fixture 36 includes a base portion 38 having blocks 40, 42, 44, 46 disposed in corresponding corners thereof. In one approach, the base portion 38 includes a wire frame that holds the corner blocks 40, 42, 44, 46 in position. Planar materials may alternatively be used. The blocks 40, 42, 44, 46 are preferably pyramidal in shape, although other shapes (e.g., square, rectangular, etc.) may alternatively be used. The actual shape of each block will typically depend upon the number and arrangement of the side panels being used. As illustrated in FIG. 5, the blocks 40, 42, 44, 46 may include detents 48, with corresponding angle indications, on appropriate sides thereof for use in setting the angle of the corresponding side panels. Stops 50 may also be provided to set upper and lower limits on the angle of the panels.

Figure 6:
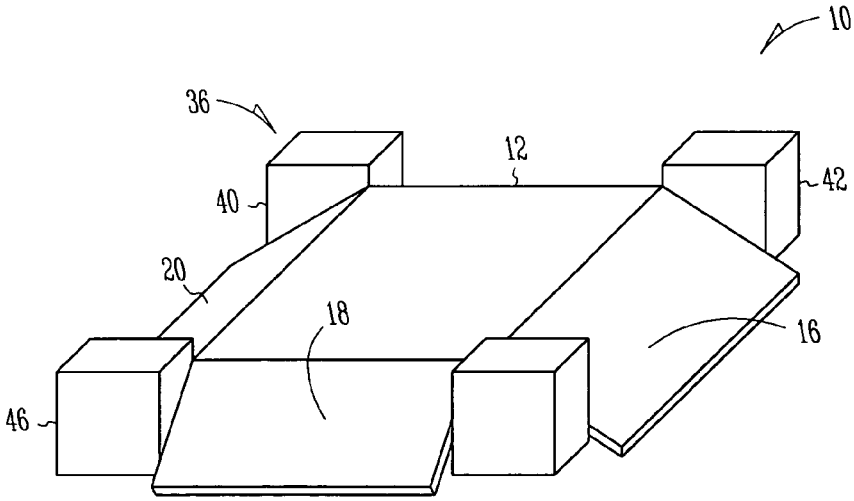
FIG. 6 is a perspective view of the fixture of FIG. 4 with an antenna system inserted therein.

FIG. 6 is a perspective view illustrating the fixture 36 of FIG. 4 with the antenna system 10 of FIG. 1 inserted therein. As shown, each of the side panels 16, 18, 20 of the antenna system 10 are press fit between corresponding pairs of blocks. After the antenna system 10 has been inserted into the fixture 36, the installer may adjust the angle of each of the side panels 14, 16, 18, 20 by moving the panel to the appropriate detent on the corresponding blocks. The panel is thereafter held in place by the compression force of the blocks. The antenna system 10 may then remain within this fixed position throughout its deployment life. In one embodiment, the blocks 40, 42, 44, 46 are formed of a lightweight plastic material, although other materials may alternatively be used. Preferably, the material will be dielectric in nature. In at least one implementation, a radome structure is attached to the blocks 40, 42, 44, 46 of the fixture 36 to cover and protect the antenna system 10 during deployment. The material used to provide the radome will preferably be low loss or transparent to radio frequency (RF) energy in the operational frequency range of the antenna system 10.

Figure 7:
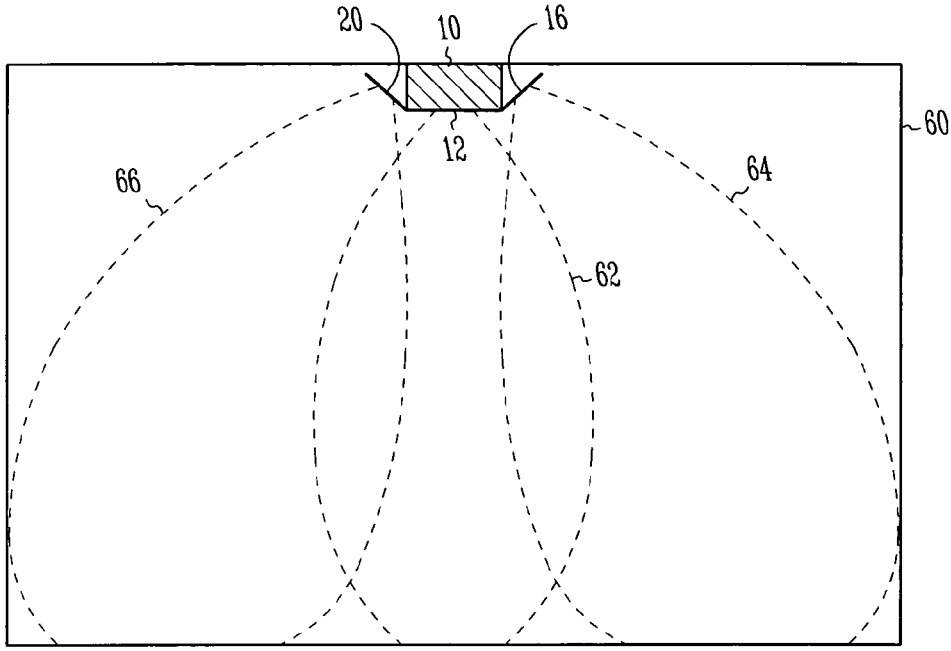
FIG. 7 is a sectional side view of a room having the antenna system of FIG. 1 ceiling-mounted therein and illustrating a possible coverage scenario of the antenna system.
Figure 8:
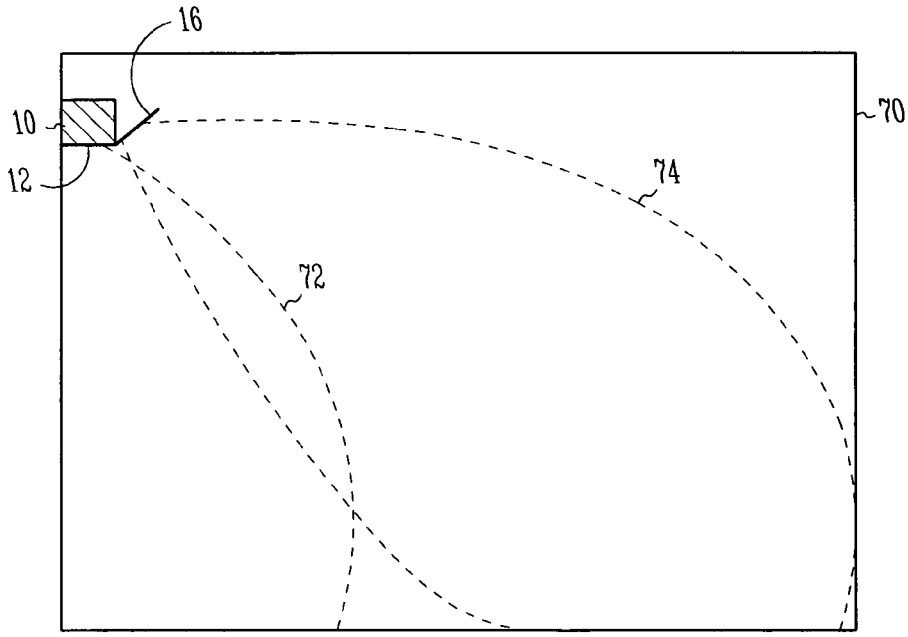
FIG. 8 is a sectional side view of a room having the antenna system of FIG. 1 wall-mounted therein and illustrating a possible coverage scenario of the antenna system.

As discussed above, the antenna system of the present invention will preferably be mounted in an elevated position within a deployment region. The side panel angles may then be adjusted and fixed in a manner that enhances the maximum data rate coverage area within the region. FIG. 7 is a sectional side view of a room 60 having a ceiling-mounted antenna system 10 for use in providing network access services to wireless users within the room 60. As shown, the main panel 12 of the antenna system 10 generates a main beam 62 in a generally downward direction that covers a central portion of the floor space of the room (side lobes may also be generated). Similarly, side panel 16 generates a main beam 64 in a generally downward direction that covers a side portion of the floor space and side panel 20 generates a main beam 66 in a generally downward direction that covers an opposite side portion of the floor space. Similar beams may be generated by the other side panels 14, 18 of the antenna system 10. Because almost the entire floor space is illuminated in a relatively uniform fashion, maximum data rates may be supported throughout the room 60. FIG. 8 illustrates a room 70 having a wall-mounted antenna system 10 that includes a main panel 12 and a single side panel 16. The main panel 12 generates a beam 72 in a generally downward direction that covers a first side portion of the floor space of room 70 and side panel 16 generates a beam 74 in a generally downward direction that covers a second side portion of the floor space of room 70. As will be appreciated, many alternative antenna system deployment scenarios are also possible.

Figure 9:
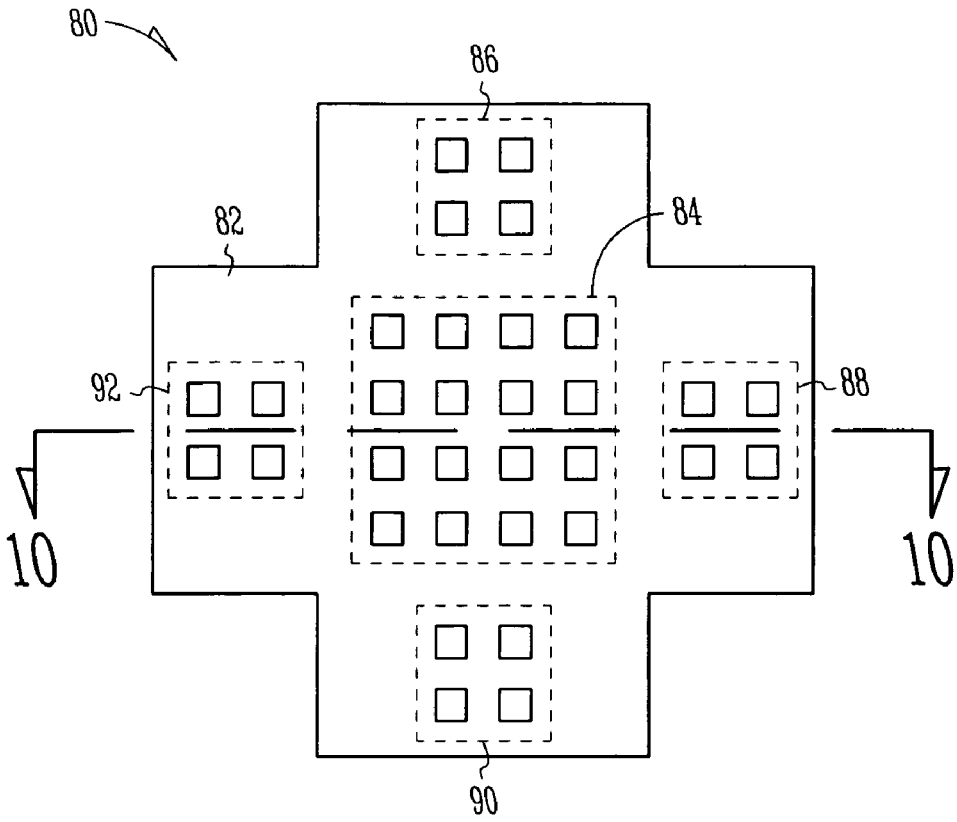
FIG. 9 is a bottom view of an antenna system in accordance with still another embodiment of the present invention.

FIG. 9 is a bottom view of an antenna system 80 in accordance with another embodiment of the present invention. The antenna system 80 includes a single panel 82 having a number of separate antenna arrays 84, 86, 88, 90, 92 disposed thereon. In the illustrated embodiment, the panel 82 includes a main array 84 centrally located on the panel 82 and four side arrays 86, 88, 90, 92 distributed around the main array 84. The number, size, and arrangement of the arrays on the panel 82 and the size and shape of the panel 82 may vary from implementation to implementation. During operation, each of the arrays 84, 86, 88, 90, 92 on the panel 82 generates a corresponding antenna beam (receive and/or transmit). The antenna system 80 maybe electronically adjusted during installation to maximize the area of full data rate coverage within a corresponding deployment region. In one approach, for example, each of the side arrays 86, 88, 90, 92 has an electronically steerable beam that may be adjusted by the installer during the installation process. The installer may, for example, make one or more measurements within the deployment region (e.g., deployment height, room size, distance to walls, etc.) and then set the angles of the individual beams accordingly using phased array techniques. In at least one embodiment, the shapes of one or more of the individual beams may also be adjusted during installation (by, for example, adjusting the excitation amplitude and phase of individual elements within a corresponding array). The beam generated by the main array 84 may or may not be adjustable. In at least one embodiment, a single antenna element is used in place of the main array 84. Separate beamformers maybe provided for each of the arrays 84, 86, 88, 90, 92 on the panel 82. Once an installer has achieved an optimal beam direction and/or shape for the beam associated with one of the arrays 84, 86, 88, 90, 92, the corresponding phase and/or amplitude values are fixed within the associated beamformer and do not change thereafter (unless the antenna system 80 is subsequently moved or a periodic recalibration is performed).

Figure 10:
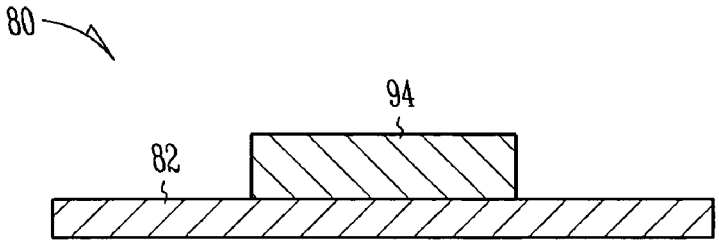
FIG. 10 is a sectional side view of the antenna system of FIG. 9.

FIG. 10 is a sectional side view of the antenna system 80 of FIG. 9. As shown, the antenna system 80 may include an optional mount 94 coupled to the panel 82 for use in mounting the system 80 within the deployment region. The mount may include any structure or structures capable of facilitating attachment of the antenna system 80 in an elevated position in the deployment region.

Figure 11:
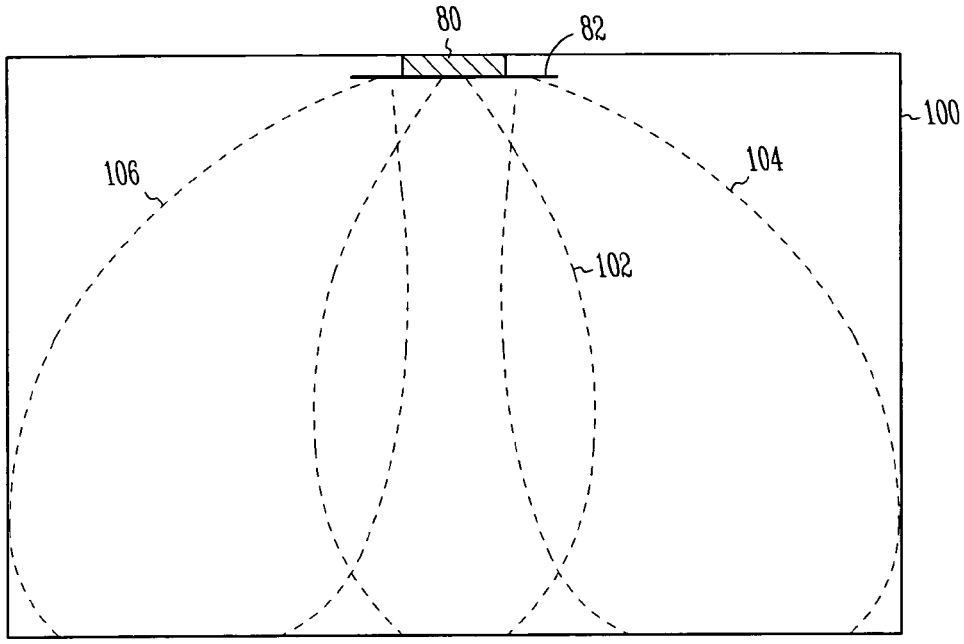
FIG. 11 is a sectional side view of a room having the antenna system of FIG. 9 ceiling-mounted therein and illustrating a possible coverage scenario of the antenna system.
Figure 12:
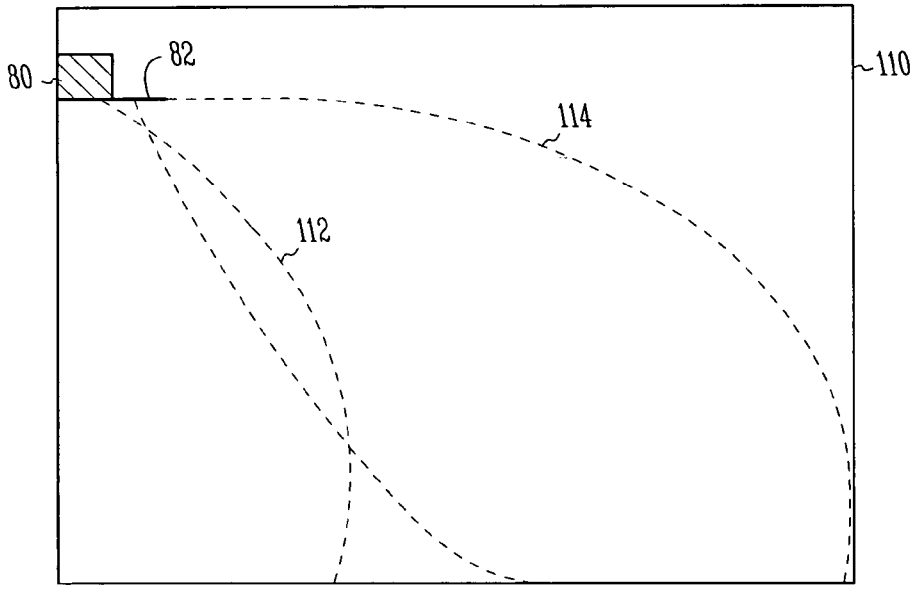
FIG. 12 is a sectional side view of a room having the antenna system of FIG. 9 wall-mounted therein and illustrating a possible coverage scenario of the antenna system.

FIG. 11 is a sectional side view of a room 100 having a ceiling-mounted antenna system 80 for use in providing network access services to wireless users within the room 100. As shown, the panel 82 of the antenna system 80 generates a main beam 102 in a generally downward direction that covers a central portion of the floor space of the room 100. Similarly, one side array on the panel 82 generates a beam 104 that covers a side portion of the floor space and another side array generates a beam 106 that covers an opposite side portion of the floor space. Similar beams may be generated by the other side arrays on the panel 82. Because almost the entire floor space is illuminated in a relatively uniform fashion, maximum data rates may be supported throughout the room 100. FIG. 12 illustrates a room 110 having a wall-mounted antenna system 80. The main antenna array on the panel 82 generates a beam 112 that covers a first side portion of the floor space of room 110 and a side array on the panel 82 generates a beam 114 that covers a second side portion of the floor space of room 110. As will be appreciated, many alternative antenna system deployment scenarios are also possible.

Figure 13:
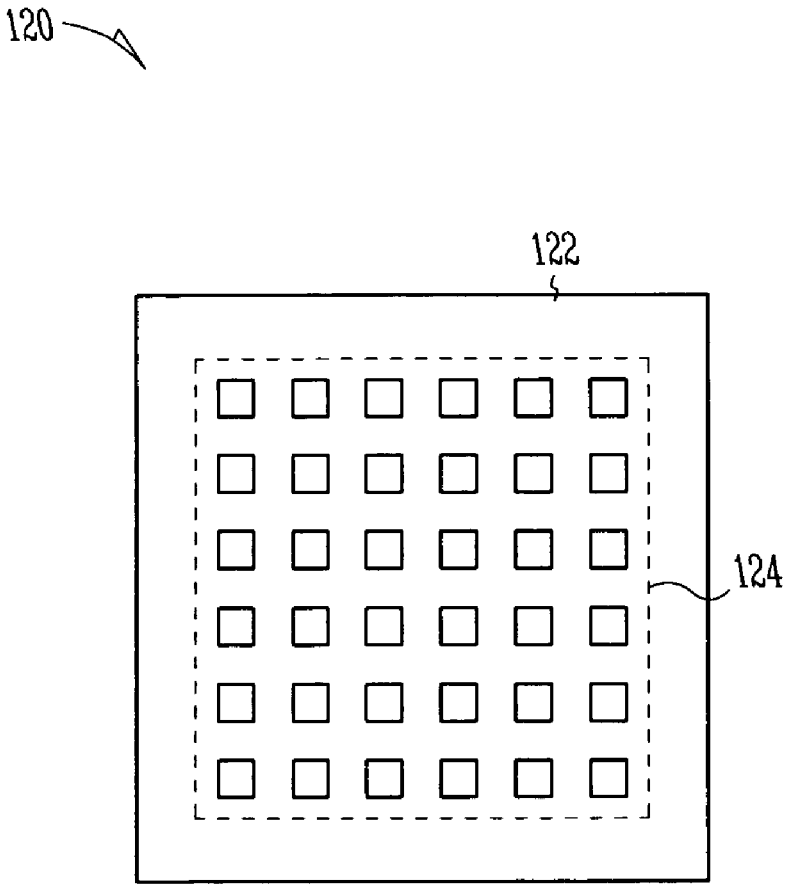
FIG. 13 is a bottom view of an antenna system in accordance with yet another embodiment of the present invention.

FIG. 13 is a bottom view of an antenna system 120 in accordance with yet another embodiment of the present invention. The antenna system 120 includes a single panel 122 having an array 124 of antenna elements disposed thereon. The number and type of elements within the array 124 and the size and shape of the panel 122 may vary from implementation to implementation. During operation, the array 124 generates multiple simultaneous antenna beams (receive and/or transmit) within a deployment region. A multiple-beam beamforming network is used in conjunction with the array 124 to generate the multiple antenna beams. The multiple-beam beamforming network will typically be co-located with the antenna system 120. Such beam forming structures are well known in the art. In one implementation, one or more of the beams generated by the array 124 are electronically steerable to allow an installer to adjust the beam(s) in a manner that enhances the maximum data rate coverage area of the system 120 within the deployment region. After optimal beam positions have been achieved for a particular deployment region, the beamformer settings are fixed and the beams remain stationary thereafter.

Although the present invention has been described in conjunction with certain embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. An antenna system for use in providing short-range wireless access to a network, comprising:

a first panel having a first surface and an opposite second surface wherein at least one antenna element is disposed on the first surface to generate a first antenna beam;

a second panel, pivotably coupled to said first panel, having at least one antenna element disposed thereon to generate a second antenna beam wherein the second panel is adapted to pivot so as to form an obtuse angle between the second panel and the second surface of the first panel; and a mount, coupled to the second surface of the first panel, to mount said antenna system in an elevated position within a network access deployment region so that each of the antenna beams are directed in a generally downward direction within the network access deployment region.

2. The antenna system of claim 1 wherein:

the antenna elements disposed on the first panel and the second panel each comprise microstrip patch elements, dipoles, ground planes, slots, or loops, or combinations of microstrip patch elements, dipoles, ground planes, slots, and loops with linear, circular, elliptical, or cross-polarization; and further comprising an adjustable beamformer network to adjust excitation phases and amplitudes of the antenna elements to electronically adjust a shape of each of the first antenna beam and the second antenna beam and to adjust excitation phases of the antenna elements to electronically adjust a direction of each of the first antenna beam and the second antenna beam.

3. The antenna system of claim 1, wherein:

said mount includes a ceiling mount.

4. The antenna system of claim 1, wherein:

said mount includes a wall mount.

5. The antenna system of claim 1, comprising:

at least one additional panel, pivotably coupled to said first panel, having at least one antenna element disposed thereon to generate at least one additional antenna beam.

6. The antenna system of claim 1, wherein:

said first panel includes an array of antenna elements to generate said first antenna beam.

7. The antenna system of claim 1, wherein:

said second panel includes an array of antenna elements to generate said second antenna beam.

8. The antenna system of claim 1, comprising:

a locking mechanism to lock said second panel in a fixed angular position with respect to said first panel.

9. The antenna system of claim 8, wherein:

said locking mechanism includes a fixture having multiple blocks to hold said second panel in a fixed position using compression.

10. The antenna system of claim 1, comprising:

a flat reflective element coupled to said second panel for use in adjusting an angle of the second panel with respect to said first panel during installation.

11. An antenna system for use in providing short-range wireless access to a network, comprising:

a panel having an array of antenna elements disposed thereon, said array of antenna elements to generate, in conjunction with a multiple-beam beamformer matrix, multiple simultaneous antenna beams, said multiple simultaneous antenna beams including at least one beam that is electronically steerable; and a mount, coupled to said panel, to mount said antenna system in an elevated position within a network access deployment region so that said multiple simultaneous antenna beams are directed in a generally downward direction within the network access deployment region.

12. The antenna system of claim 11, wherein:

said mount includes a ceiling mount.

13. The antenna system of claim 11, wherein:

said mount includes a wall mount.

14. The antenna system of claim 11, wherein the multiple-beam beamformer matrix is structured to adjust excitation phases and amplitudes of the array of antenna elements to electronically adjust shapes of the multiple simultaneous antenna beams and to adjust excitation phases of the array of antenna elements to electronically adjust directions of the multiple simultaneous antenna beams.

15. The antenna system of claim 11, wherein the array of antenna elements comprises microstrip patch elements, dipoles, ground planes, slots, or loops, or combinations of microstrip patch elements, dipoles, ground planes, slots, and loops with linear, circular, elliptical, or cross-polarization.

16. A system comprising:

a first panel having at least one antenna element disposed on the first panel to generate a first antenna beam;

a plurality of additional panels, wherein at least one of the plurality of additional panels includes at least one antenna element disposed thereon, wherein the plurality of additional panels are pivotably attached to the first panel and arranged about the first panel wherein one of the additional panels is adjacent to at least one other additional panel; and at least one support member disposed between two adjacent additional panels of the plurality of additional panels and adapted to yieldably hold the two adjacent additional panels in relation to the first panel.

17. The system of claim 16 wherein the at least one support member is a block disposed between edges of the two adjacent additional panels.

18. The system of claim 16, wherein:

the antenna elements comprise microstrip patch elements, dipoles, ground planes, slots, or loops, or combinations of microstrip patch elements, dipoles, ground planes, slots, and loops with linear, circular, elliptical, or cross-polarization; and further comprising:

an adjustable beamformer network to adjust excitation phases and amplitudes of the antenna elements to electronically adjust shapes of multiple antenna beams generated by the first panel and the additional panels, and to adjust excitation phases of the antenna elements to electronically adjust directions of the multiple antenna beams generated by the first panel and the additional panels; and a ceiling mount or a wall mount coupled to the first panel to mount the system in an elevated position within a network access deployment region so that each of multiple antenna beams generated by the first panel and the additional panels are directed in a generally downward direction within the network access deployment region.

19. An antenna system for use in providing short-range wireless access to a network, comprising:

a panel having at least one first antenna element to generate a first antenna beam and an array of second antenna elements to generate a second antenna beam, wherein said second antenna beam is electronically steerable with respect to said first antenna beam using phased array techniques;

a mount, coupled to said panel, to mount said antenna system in an elevated position within a network access deployment region so that said first antenna beam and said second antenna beam are directed in a generally downward direction within the network access deployment region; and an adjustable beamformer network to adjust excitation phases and amplitudes of the array of second antenna elements to electronically adjust a shape of the second antenna beam and to adjust excitation phases of the array of second antenna elements to electronically adjust a direction of the second antenna beam.

20. An antenna system for use in providing short-range wireless access to a network, comprising:

a panel having at least one first antenna element to generate a first antenna beam and an array of second antenna elements to generate a second antenna beam, wherein said second antenna beam is electronically steerable with respect to said first antenna beam using phased array techniques;

a mount, coupled to said panel, to mount said antenna system in an elevated position within a network access deployment region so that said first antenna beam and said second antenna beam are directed in a generally downward direction within the network access deployment region; and wherein said panel further includes at least one additional array of antenna elements to generate at least one additional antenna beam, wherein said at least one additional antenna beam is electronically steerable with respect to said first and second antenna beams; and further comprising an adjustable beamformer network to adjust excitation phases and amplitudes of the additional array of antenna elements to electronically adjust a shape of the additional antenna beam and to adjust excitation phases of the additional array of antenna elements to electronically adjust a direction of the additional antenna beam.

21. An antenna system for use in providing short-range wireless access to a network, comprising:

a panel having an array of dipole antenna elements disposed thereon, said array of dipole antenna elements to generate, in conjunction with a multiple-beam beamformer matrix, multiple simultaneous antenna beams, said multiple simultaneous antenna beams including at least one beam that is electronically steerable; and a mount, coupled to said panel, to mount said antenna system in an elevated position within a network access deployment region so that said multiple simultaneous antenna beams are directed in a generally downward direction within the network access deployment region.

22. The antenna system of claim 21 wherein said mount includes a ceiling mount.

23. The antenna system of claim 21 wherein said mount includes a wall mount.

24. The antenna system of claim 21 wherein the multiple-beam beamformer matrix is structured to adjust excitation phases and amplitudes of the array of dipole antenna elements to electronically adjust shapes of the multiple simultaneous antenna beams and to adjust excitation phases of the array of dipole antenna elements to electronically adjust directions of the multiple simultaneous antenna beams.

25. A method comprising:

generating multiple simultaneous antenna beams from an array of antenna elements disposed on a panel mounted in an elevated position within a network access deployment region;

electronically steering at least one of said multiple simultaneous antenna beams with a multiple-beam beamformer matrix; and directing said multiple simultaneous antenna beams in a generally downward direction within the network access deployment region to provide short-range wireless access to a network.

26. The method of claim 25, further comprising mounting said panel on a ceiling.

27. The method of claim 25, further comprising mounting said panel on a wall.

28. The method of claim 25, further comprising adjusting shapes of the multiple simultaneous antenna beams by adjusting excitation phases and amplitudes of the array of antenna elements with the multiple-beam beamformer matrix.

29. The method of claim 25, further comprising adjusting directions of the multiple simultaneous antenna beams by adjusting excitation phases of the array of antenna elements with the multiple-beam beamformer matrix.

30. The method of claim 25, further comprising generating said multiple simultaneous antenna beams from an array of microstrip patch elements, dipoles, ground planes, slots, or loops, or combinations of microstrip patch elements, dipoles, ground planes, slots, and loops with linear, circular, elliptical, or cross-polarization disposed on said panel.

31. A method comprising:

mounting a first panel having a first surface and an opposite second surface in an elevated position within a network access deployment region with a mount coupled to said second surface of said first panel;

generating a first antenna beam from at least one antenna element disposed on said first surface of said first panel;

pivoting a second panel coupled to said first panel to form an obtuse angle between said second panel and said second surface of said first panel;

generating a second antenna beam from at least one antenna element disposed on said second panel; and directing each of said antenna beams in a generally downward direction within said network access deployment region to provide short-range wireless access to a network.

32. The method of claim 31, further comprising mounting said second surface on a ceiling.

33. The method of claim 31, further comprising mounting said second surface on a wall.

34. The method of claim 31, further comprising pivoting at least one additional panel coupled to said first panel, the at least one additional panel having at least one antenna element disposed thereon to generate at least one additional antenna beam.

35. The method of claim 31, further comprising generating said first antenna beam from an array of antenna elements disposed on the first surface of said first panel.

36. The method of claim 31, further comprising generating said second antenna beam from an array of antenna elements disposed on said second panel.

37. The method of claim 31, further comprising locking said second panel in a fixed angular position with respect to said first panel with a locking mechanism.

38. The method of claim 31, further comprising locking said second panel in a fixed angular position with respect to said first panel with a fixture having multiple blocks to hold said second panel in a fixed position using compression.

39. The method of claim 31, wherein pivoting a second panel further comprises using a flat reflective element coupled to said second panel to adjust an angle of said second panel with respect to said first panel.

* * * * *